United States Patent [19]

Brookhart, Jr.

[11] Patent Number: 4,899,514

[45] Date of Patent: Feb. 13, 1990

[54] BALLAST BLOCK FOR ROOFING STRUCTURES

[76] Inventor: George C. Brookhart, Jr., 1557 W. Briarwood Ave., Littleton, Colo. 80120

[21] Appl. No.: 797,458

[22] Filed: Nov. 13, 1985

[51] Int. Cl.[4] ..... E04D 1/16

[52] U.S. Cl. ..... 52/553; 52/535; 52/536; 52/543; 52/544; 52/547

[58] Field of Search ..... 52/519, 534, 536, 533, 52/535, 543, 547, 549

[56] References Cited

U.S. PATENT DOCUMENTS

| | | | |
|---|---|---|---|
| 196,773 | 11/1877 | Stripe | 52/536 |
| 209,310 | 10/1878 | Wands | 52/533 |
| 318,872 | 5/1885 | Crabbe | 52/536 |
| 477,346 | 6/1892 | Wood | 52/536 |
| 487,925 | 12/1892 | Haring | 52/536 |
| 494,543 | 4/1893 | Betts | 52/533 |
| 774,740 | 11/1904 | Darnall | 52/534 |
| 1,226,888 | 5/1917 | Hughes et al. | 52/536 |
| 1,427,968 | 9/1922 | Pederson | 52/533 |
| 1,658,591 | 2/1928 | Dorn | 52/543 |
| 2,004,198 | 6/1935 | Fall | 52/536 |
| 2,353,455 | 7/1944 | Gisondi | 52/547 |
| 2,357,722 | 9/1944 | Balduf | 52/547 |
| 2,447,275 | 8/1948 | Price | 52/543 |
| 3,775,925 | 12/1973 | Fujita | 52/547 |
| 3,783,570 | 1/1974 | Storch | 52/536 |
| 4,065,899 | 1/1978 | Kirkhuff | 52/536 |
| 4,372,090 | 2/1983 | Shichijo | 52/536 |
| 4,397,126 | 8/1983 | Nelson | 52/408 |

FOREIGN PATENT DOCUMENTS

| | | | |
|---|---|---|---|
| 643327 | 6/1962 | Canada | 52/519 |
| 1708994 | 1/1979 | Fed. Rep. of Germany | 52/536 |
| 1001942 | 2/1952 | France | 52/519 |
| 652258 | 4/1951 | United Kingdom | 52/533 |

*Primary Examiner*—Michael Safavi

[57] ABSTRACT

A ballast block is disclosed in the form of a planar plate member. The plate member has a top and bottom surface, front and rear end portions and oppositely disposed lateral edges. The end portions include a mechanism for preventing substantial uplift and rotational displacement of the block when its end portions are interlinked in overlapping relationship with the corresponding end portions of like ballast blocks.

77 Claims, 4 Drawing Sheets

BALLAST BLOCK FOR ROOFING STRUCTURES

BACKGROUND OF THE INVENTION

1. Field of the Invention

The present invention relates generally to roofing structures and, more particularly, to ballast blocks designed for use in single ply roofing construction. Specifically, the present invention relates to an improved ballast block construction wherein the ends of such ballast blocks may be interlinked to prevent uplift and rotational displacement due to wind forces.

2. Description of the Prior Art

For many years, flat roofs generally found on commercial structures have traditionally utilized built-up roofing technology. The standard composite-type roof is an example of such technology. However, single-ply membrane roofing has been growing in popularity over the years and has captured a substantial portion of the flat roof market. The significant advantages of single-ply roofing are that such structures are easier to install, more reliable and economical, and much more durable.

In single-ply roofing construction, a waterproof single-ply membrane is laid over a layer of insulation, and both layers are held in place by a ballast system. The single-ply membrane is commonly made from rubber, plastic or some other type of waterproof material. Of the various techniques commonly used for installing the single-ply membranes, the most popular is loose laid, either over or under the roof insulation. These materials are then held in place by the ballast.

Conventionally, there are four basic types of ballast systems presently in use. The first of these includes a layer of loose laid, well-rounded stones having diameters generally ranging from $\frac{3}{4}$ to $1\frac{1}{2}$ inches and applied at a design rate of about 10 pounds per square foot. Second, standard paving blocks can be used having a nominal thickness of $1\frac{7}{8}$ inches to $2\frac{1}{4}$ inches with a unit weight of 18–25 pounds per square foot. A third type includes a composite tongue and groove board made with a layer of heavy concrete bonded to an extruded polystyrene insulation and having a unit weight of about 5–6 pounds per square foot. Finally, lighter weight ballast blocks which are specifically designed for single-ply roofing structures have also been utilized.

Each of the above ballast systems has been applied in a variety of circumstances. Criteria for ballast systems as developed by building codes, insurance requirements and various manufacturers, indicate that ballast for single-ply, loose laid membranes must be placed in such a fashion that the total coverage of the waterproof membrane is obtained while satisfying four basic conditions. The ballast must adequately protect the membrane from uplift forces developed from naturally occurring winds. The ballast system must provide adequate coverage to prevent flame spread and damage from flying hot embers. The ballast must also protect the membrane layer from the deleterious effects of ultraviolet rays from the sun. Finally, the ballast must provide a layer which protects the membrane from puncturing, tearing and the like.

Failure of ballasted roof systems generally occurs when a sufficient amount of the ballast material actually moves out of position on the roof thereby exposing the underlying insulation or membrane to the direct action of wind and/or sunlight. This can cause substantial damage since the membrane may degenerate due to sun exposure or be ripped and blown off the roof by the wind. It has been documented that loose laid stone will vibrate, scour, and even become airborne under certain wind conditions. Thus, ballast systems incorporating loose stone have not generally provided an adequate roofing structure over a prolonged period of time, although it has been one of the more popular systems due to its ease of installation. It has also been found that conventional ballast blocks may be subject to uplift from wind forces as well as freezing of ponded water. This uplift can cause rotation of the blocks and thereby expose the underlying membrane to the environment. Moreover, the uplift of ballast blocks can puncture and tear the underlying membrane material as a result of the abrasive effect of the block against the membrane. Thus, there is still a need for a ballast system or structure which is designed to provide adequate ballast, proper drainage, a walking surface across the roof which prevents puncturing of the membrane therebelow, as well as a structure which is resistant to wind uplift forces including substantial wind forces of 80 mph or above.

SUMMARY OF THE INVENTION

Accordingly, it is one object of the present invention to provide an improved roofing structure for flat-type roofs.

It is another object of the present invention to provide a ballast system for single-ply roof structures.

It is yet another object of the present invention to provide a ballast block construction having improved resistance to wind uplift forces while providing improved drainage capabilities.

To achieve the foregoing and other objects and in accordance with the purpose of the present invention, a ballast block is provided in the form of a planar plate member. The plate member includes top and bottom surfaces, front and rear end portions, and oppositely disposed lateral edges. The end portions include mechanisms for preventing substantial uplift and rotational displacement of the block when the end portions are interlinked in overlapping relationship with the corresponding end portions of like ballast blocks.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings and in which:

DETAILED DESCRIPTION OF THE PREFERRED EMBODIMENTS

Flat roof structures are generally recessed relative to the top edge of the wall member surrounding the roof. This creates a parapet structure relative to the roof surface which, while substantially flat, does nonetheless have a slight pitch for drainage purposes. When wind passes over the parapet, it creates a vacuum effect along the surface of the roof and especially along the roof perimeter area proximate to the parapet. This vacuum effect causes substantial uplift forces on any ballast material covering the roof structure, especially at the roof perimeter. Moreover, the mere passing of the wind across the surface of the roof can also create differential air pressures resulting in uplift of ballast material, even heavy concrete blocks. Thus, in the instance wherein concrete blocks are utilized as ballast and provide vacant areas beneath them for drainage purposes, differential air pressures created between the upper and lower surfaces of the block due to winds passing over the blocks tend to enhance rather than decrease wind uplift effects. The present invention is designed to substantially avoid the uplifting of such blocks due to wind uplift while providing increased drainage capability.

In certain cases where the direct uplift effects of blocks due to wind are substantially reduced, there is still a subsequent tendency for the ballast blocks to rotate when they are prevented from moving upwardly in response to the uplift forces imposed on them. The present invention also provides a mechanism for preventing this rotational effect in conjunction with the reduction of substantial uplift effects due to wind forces.

Figure 1:
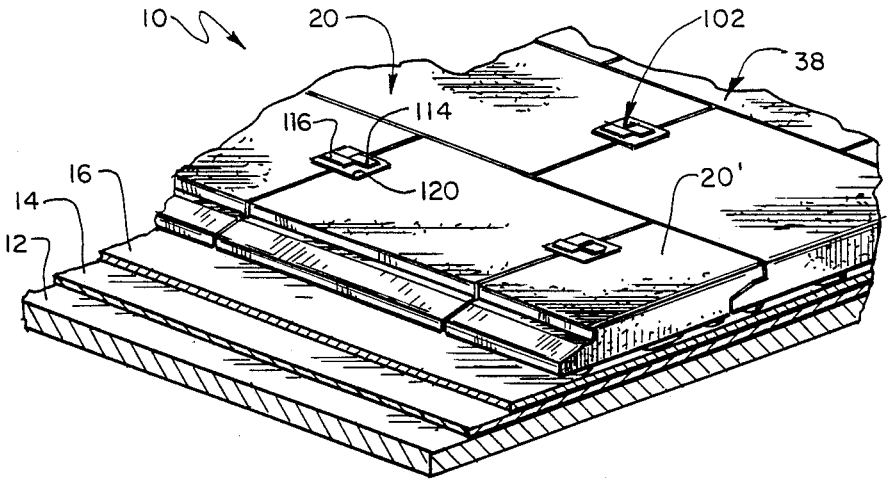
FIG. 1 is a perspective view, with portions cut away, of a roof assembly constructed in accordance with the present invention.
Figure 2:
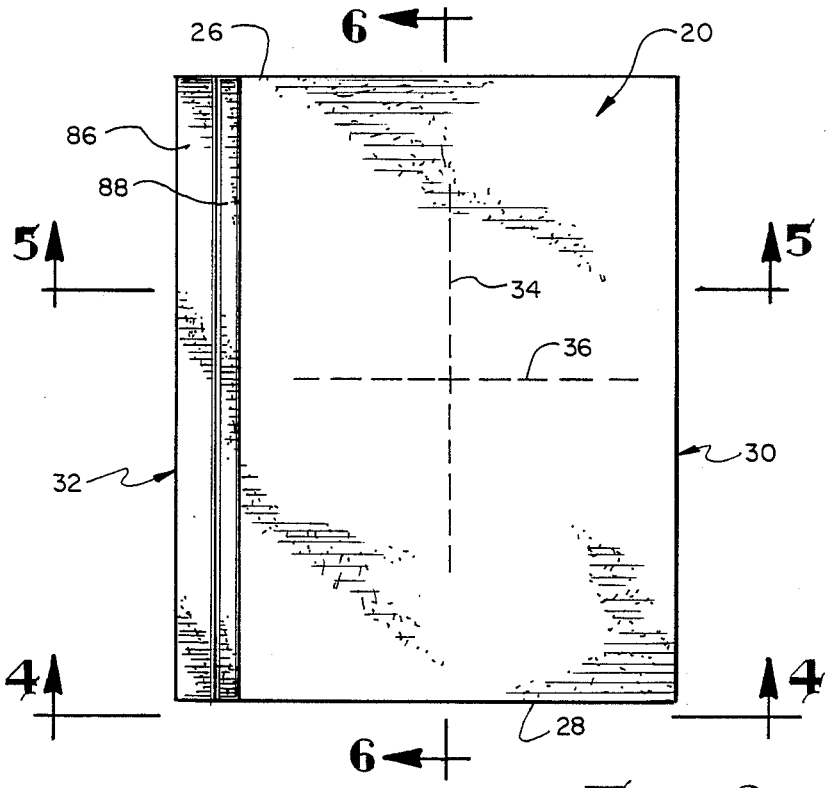
FIG. 2 is a plan view of a ballast block structure constructed in accordance with the present invention.
Figure 3:
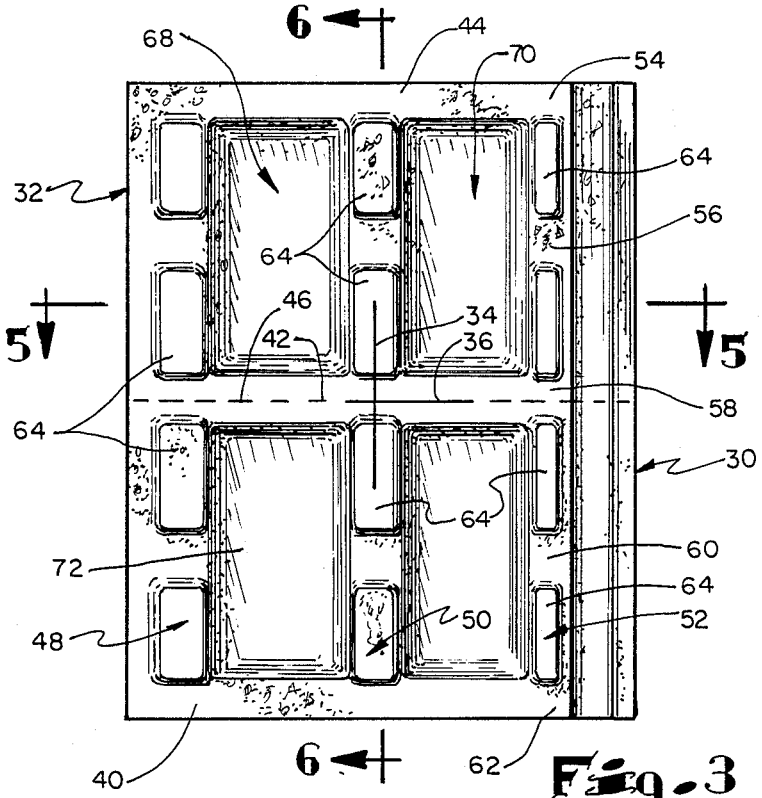
FIG. 3 is a bottom view of the ballast block structure illustrated in FIG. 2.
Figure 4:
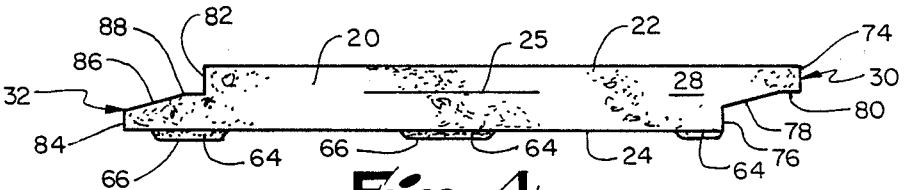
FIG. 4 is an end view of the ballast block structure illustrated in FIGS. 2 and 3 and taken substantially along line 4—4 of FIG. 2.
Figure 5:
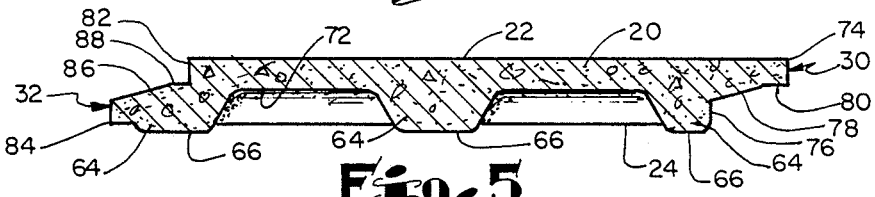
FIG. 5 is a cross sectional view taken substantially along lines 5—5 of FIGS. 2 and 3.
Figure 6:
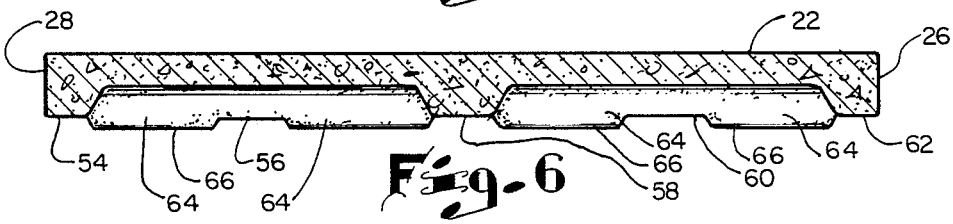
FIG. 6 is another cross sectional view taken substantially long lines 6—6 of FIGS. 2 and 3.

Referring, now, to FIG. 1, a roof structure 10 is disclosed. The roof structure 10 conventionally includes a roof deck 12 which is covered by a layer of sheathing or insulating material 14. A waterproof layer 16 may be provided and is typically a sole, single-ply waterproof membrane laid down across the insulation 14. The layer 16 may be made from rubber, polyurethane or any other conventionally known waterproof material utilized in such roofing structures. The purpose of layer 16 is to cover the entire deck 12 and layer 14 so as to prevent water and other liquids from seeping therethrough. To protect the membrane 16 from the environment as well as to hold it in place, a plurality of ballast blocks 20 are provided. The ballast blocks 20 are preferably aligned in a row abutting each other along their lateral side portions with adjacent rows being positioned in staggered formation to prevent a continuous alignment of abutting side junctures. This staggered formation is clearly illustrated in FIG. 1.

Referring more particularly to FIGS. 2–6, each ballast block 20 is generally constructed in the form of a unitary planar plate member. The block 20 may be constructed from any known material suitable for use as a roof ballast material and is preferably constructed from integrally molded concrete having a preferred weight of approximately 10 lbs./sq.foot. The block 20 includes a top surface 22 and a bottom surface 24 which are aligned generally parallel with the longitudinal plane 25 of the planar block 20. Oppositely disposed lateral side edges 26 and 28 are provided, and the block also includes a front end portion 30 and a rear end portion 32. The lateral side edges 26 and 28 are preferably flat surfaces aligned substantially parallel with each other and substantially perpendicular to the plane 25 as well as to a first lateral axis 34. The front and rear end portions 30 and 32 are generally aligned parallel with the first axis 34 and substantially perpendicular to a second, longitudinally oriented, axis 36. The axes 34 and 36 are perpendicular to each other and lie within the plane 25.

The upper surface 22 is preferably flat so as to provide a smooth surface for walking and the like. The lateral side portions 26 and 28 are preferably perpendicular to the surfaces 22 and 24 and the plane 25 and form flat straight surfaces which readily abut similar side portions 26 or 28 of adjacent blocks 20. As illustrated specifically in FIG. 1, the blocks 20 are preferably sized and shaped in identical fashion so as to readily fit together to form a continuous roofing surface 38.

The bottom surface 24 includes a plurality of structural configurations which assist in the various functions of the block 20. In preferred form, the bottom surface 24 includes three solid ridge members 40, 42, and 44 that are aligned parallel with the axis 36. The ridges 40 and 44 form the lateral side portions 28 and 26, while the ridge 42 is disposed centrally along the bottom surface 24 so as to divide the bottom surface 24 into two identical portions. In fact, the center ridge 42 is designed so that if it is bifurcated along its centerline 46, which is aligned with the axis 36, the block 20 is divided into two separate but equal portions. This function is useful when laying the staggered end portions of the roofing surface 38 as indicated by the half block portion 20' of FIG. 1.

Three elongated rib-like portions 48, 50, and 52 are also provided along the bottom surface 24 and are aligned substantially parallel with the axis 34 so as to be aligned perpendicular to the ridges 40, 42 and 44. Each of the ribs 48, 50 and 52 are divided into segments by plurality of channels 54, 56, 58, 60 and 62, the channels 54, 58 and 62 being defined by the bottom surface portions of the ridges 40, 42 and 44, respectively. In preferred form, the channels 54–62 divide each of the ribs 48, 50 and 52 into four segments 64 of generally similar size and shape, thereby forming twelve such segments or pads 64, although the number and similarity in size and shape are not necessary to the proper function of the present invention. The segments 64 project outwardly from the bottom surface 24 compared to the remaining structural configurations of the surface 24 so as to form a plurality of pads upon which the block 20 rests. Thus, the bottom surfaces 66 of the segments or pads 64 form the surface contact area of the bottom surface 24 of the block 20. The ribs 48, 50 and 52 also define two parallel pathways 68 and 70 between them, which pathways permit fluid flow beneath the block 20 along the axis 34 parallel with the front and rear end portions 30, 32. Likewise, the channels 54, 56, 58, 60 and 62 permit fluid flow along the axis 36 parallel with the lateral side edges 26 and 28. Consequently, the ballast block 20 has bidirectional drainage beneath it which prevents ponding of water therebelow. This in turn prevents uplift of the blocks 20 caused by the freezing and expansion of such ponded water, a problem with prior ballast block designs.

In the preferred form of the block 20, recessed portions 72 are provided within the pathways 68 and 70 and between the rib portions 48, 50 and 52. These recessed portions 72 aid in the free flowage of liquid beneath the block 20 as well as to control the weight of the block 20. Moreover, it should further be noted that the individual segments or pads 64 permit the block 20 to be rested upon a relatively uneven surface and still maintain stability as opposed to providing solid ridges upon which to rest the block 20.

Referring more particularly to FIGS. 2, 4, 5 and 7–9, the front end portion 30 is divided into several separate and distinct surface areas. More specifically, a first front surface 74 is aligned substantially perpendicular to the plane 25 and the axis 36 while being substantially parallel to the axis 34. The first surface 74 extends downwardly from the top surface 22. A second front surface 76 extends upwardly from the bottom surface 24 and, like the first surface 74, is aligned substantially perpendicular to the plane 25, the axis 36 and the bottom surface 24 and substantially parallel with the axis 34. The surfaces 74 and 76 are parallel with each other and are interconnected by a third surface 78 which is obliquely inclined relative to the surfaces 74 and 76 and the plane 25.

The third surface 78 of the front end portion 30 is adapted to intersect either one of the two parallel first and second surfaces 74, 76. In preferred form, the third surface 78 directly intersects the second surface 76 and projects forwardly at an oblique angle to intersect a fourth surface 80. The fourth surface 80 is aligned substantially parallel with the plane 25 and the upper surface 22 and is perpendicular to the first surface 74. Thus, the fourth surface 80 acts as a bridging surface between the inclined third surface 78 and the first surface 74 which is at the forwardmost end of the front end portion 30.

The rear end portion 32 is constructed inversely relative to the front end portion 30 so as to permit a linking cooperative engagement in a mating-like fashion between the front end portion 30 of one block 20 and the rear end portion 32 of an adjacent block 20. More specifically, the rear end portion 32 includes first and second rear end surfaces 82, 84, both of which are aligned substantially perpendicular to the top surface 22, the bottom surface 24 and the plane 25. The first and second end surfaces 82, 84 are further aligned substantially parallel with the axis 34. The surfaces 82, 84 are spaced apart by a third inclined surface 86 which is obliquely inclined relative to the plane 25 and the top and bottom surfaces 22, 24. As in the front end portion 30, the third surface 86 may intersect either of the first or second surface 82, 84, but in the preferred embodiment it directly intersects the second surface 84. A fourth surface rear end 88 acts as a bridge between the third inclined surface 86 and the first surface 82, the fourth surface 88 being parallel to the top surface 22 and the plane 25 and perpendicular to the first surface 82. Since the rear end portion 32 is inverse of the front end portion 30, the first rear end surface 82 which extends downwardly from the top surface 22 is recessed inwardly of the second surface 84, which is is rearwardmost end of the rear end portion 32.

Figure 7:
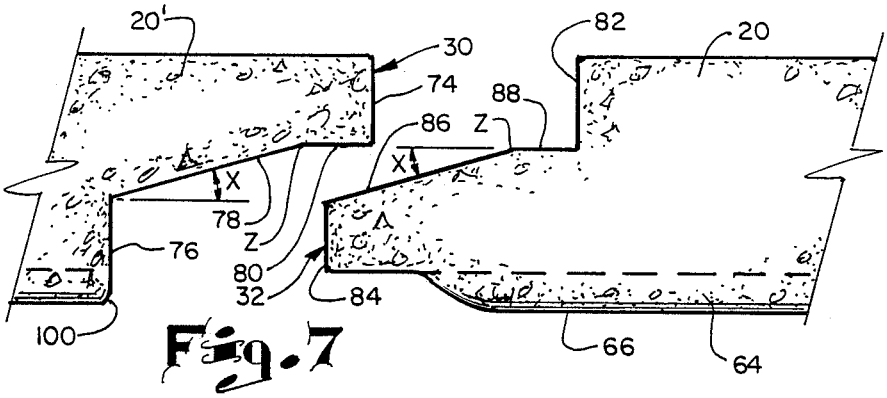
FIG. 7 is an enlarged side view of the front and rear end portions of like ballast blocks of the present invention prior to interlinking thereof.
Figure 8:
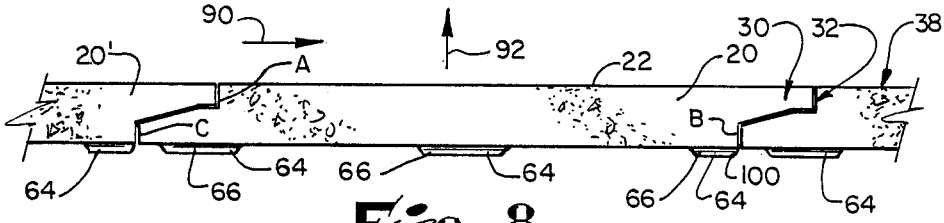
FIG. 8 is a side view, with some parts in section, of a plurality of ballast blocks constructed in accordance with the present invention and positioned in interlinking relationship.

Referring more particularly to FIGS. 7 and 8, when the front end portion 30 is interlinked with the rear end portion 32 of an adjacent block 20, the first front end surface 74 abuts the first rear end surface 82, and the second front end surface 76 abuts the second rear end surface 84. The inclined surfaces 78, 86 and the fourth surfaces 80, 88 are preferably spaced slightly from each other for reasons provided below. However, they may be sized so as to abut each other when the first and second surfaces 74, 82 and 76, 84, respectively, are brought into abutting relationship. In preferred form, the angle X, which represents the angle which the inclined surfaces 78 and 86 make with the plane 25 and the upper surface 22, may vary from 10°–40°. More specifically, the angle X is preferably 15°–20° in order to provide maximum functional characteristics in terms of resistance to wind uplift and rotational forces as described below.

As an example of the construction described above, a preferred block 20 has a total thickness between the upper surface 22 and the bottom of the pad 64 of 34 millimeters. In this arrangement, the first end surfaces 74, 82 are generally 13 millimeters each in height, while the second end surfaces 76, 84 are generally 9 millimeters each in height, although slight variances between the abutting surfaces sizes may occur in order to obtain a close fit of the end portions 30 and 32. The length of the fourth connecting surfaces 80, 88 is 10 millimeters while the distance between each second surface 76, 84 and the beginning point Z of each of the fourth surfaces 80, 88 is 26 millimeters. Finally, the height of the pads 64 which project above the surfaces of the channels 54, 62 is preferably four millimeters. This arrangement results in an angle X of 17.1°.

Figure 9:
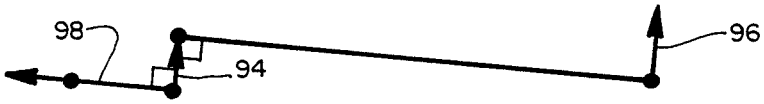
FIG. 9 is a line drawing illustrating some of the forces imposed on the structure illustrated in FIG. 8 by wind uplift.

Referring now to FIGS. 8–9, wind passing along the upper surface 22 of the plurality of interconnected blocks 20, as indicated by the arrow 90, tends to cause uplift of the blocks 20 as indicated by the arrow 92. The lift force is a function of a variety of factors including the height of the parapet (not illustrated) surrounding the roof surface 38, the velocity of the wind, the distance from the parapet to the particular block which is being investigated, and the dimensions of the block. Surrounding terrain, landscaping and height of buildings also affect the wind uplift force by affecting the velocity and direction of the wind 90.

The wind uplift force 92 tends to lift the block at point A and point B, which factors are illustrated in FIG. 9. This uplift force 92 tends to left the front end portion 30 at point B as illustrated by the arrow 96 of FIG. 9. Since the block at point A cannot move up without lifting the adjacent block 20', there is a tendency for the block 20 to rotate at point A instead. Since the tiles are placed adjacent to each other as illustrated in FIG. 1, this rotational tendency is inhibited. The resultant force, as indicated by the arrow 98 of FIG. 9, is then transmitted to the adjacent tile which in turn translates that force on down the line of ballast blocks thereby preventing uplift of the block 20. It should be noted that the edge 100 along the very bottom of the forward portion 30 is preferably smooth and curved so that any downward force exerted by the tile 20 along the edge 100 does not puncture the underlying layers. The angle of inclination X of the inclined surfaces 78 and 86 is important in order to balance the forces between the forward and rearward end portions 30, 32 and to transfer the uplift forces longitudinally to the adjacent tile 20'. Thus, when uplift forces 92 are spread throughout the entire roof assembly 38 and to the parapet edge, instead of concentrating on any particular block. In this manner, the uplifting of blocks 20 and the puncturing of underlying surface materials can be substantially prevented.

Figure 10:
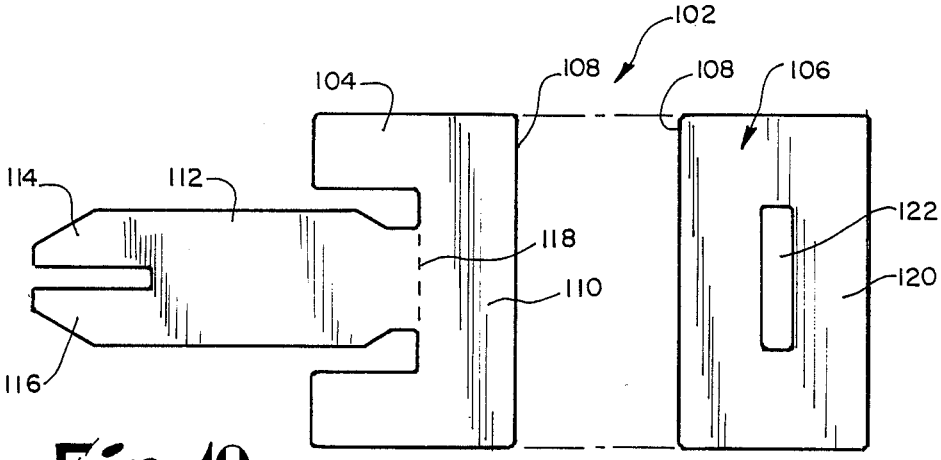
FIG. 10 is a plan view of a clamping assembly utilized to interlock side portions of adjacent ballast block structures constructed in accordance with the present invention.
Figure 11:
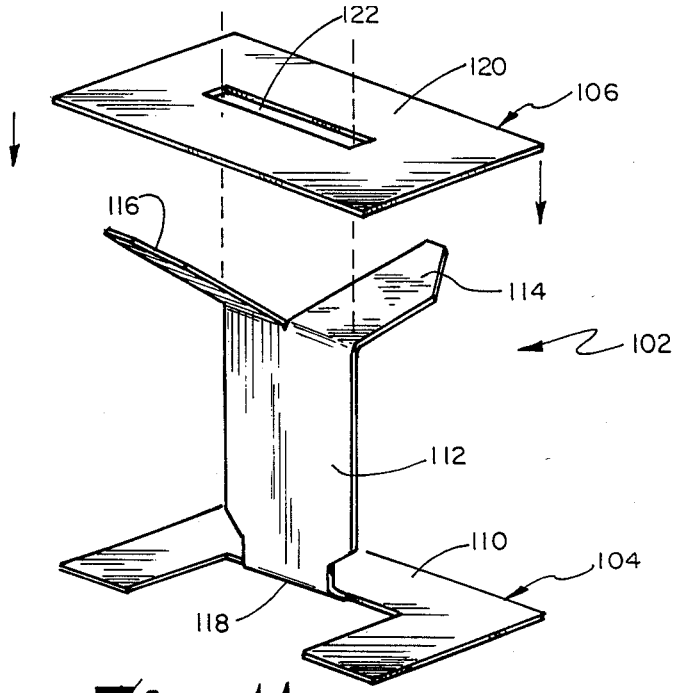
FIG. 11 is a perspective view of the clamping structure illustrated in FIG. 10 in partially assembled condition.
Figure 12:
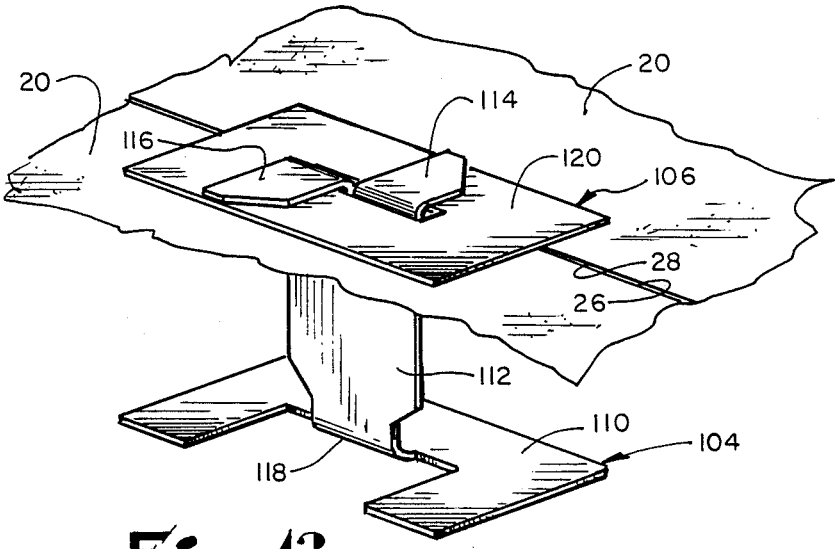
FIG. 12 is yet another perspective view of the clamping structure illustrated in FIGS. 10 and 11 in its fully assembled position.

As indicated above, the design on the block 20 permits the wind uplift forces to be spread throughout the entire assembly 38. However, the wind uplift forces tend to be strongest along the outermost perimeter rows of a roof structure due to the strength of the vacuum created immediately inside the parapet as the wind passes thereover. In order to assist the retention of the ballast blocks 20 along these perimeter rows, a clamp structure is provided to interconnect abutting lateral side portions of adjacent ballast blocks. Any desired clamping structure to hold the abutting lateral side portions together may be used in the present invention. One known way of clamping the abutting side portions together which is particularly useful with the ballast block assembly of the present invention is the clamping structure 102 illustrated in FIGS. 10–12. The clamp structure 102 includes a clamping portion 104 and a connecting element 106. The clamping portion 104 and the connector 106 are made from metal, preferably copper, and are preferably formed by metal stamping in a single structure. When the clamping member 102 is desired to be used, the connecting element 106 is disconnected from the clamping member 104 along the line 108 such as by driving the claw end of a roofing hammer into the clamping member 102 along the line 108. The clamping element 102 is then connected to the blocks 20 as described below.

The clamping member 104 includes a base member 110 with a clip element 112 secured thereto and extending therefrom. The clipping element 112 is bifurcated along its upper half into two end portions, 114 and 116. When the clamping element 102 is desired to be used, the clipping element 112 is bent upwardly 90° along the line 118 relative to the base 110 as illustrated particularly in FIG. 11. The base 110 is positioned beneath the bottom surface 24 of adjacent blocks 20 and more particularly beneath the juncture between lateral edge portions 26, 28 of adjacent blocks 20. The clip element 112 is then positioned between the side portions 26, 28 so that the clip end portions 114 and 116 project upwardly above the top surfaces 22. The connecting element 106 is in the form of a bracket 120 having a central elongated opening 122 therein. The opening 122 is sized and shaped so as to receive the clip end portion 114 and 116 therethrough as the bracket 120 slides down along the clip element 112 until it rests on the upper surface 22 bridging the adjacent blocks 20 across the juncture between the side portions 26, 28 thereof. The clip end portions 114, 116 are then bent downwardly toward the upper surface 22 so as to firmly press the bracket 120 against the surface 22 of the adjacent blocks 20 and hold them in place. In this manner, the bracket 120 is interconnected with the base portion 110 by the clip element 112 and holds the adjacent blocks 20 together relative to each other. Consequently, one block member 20 cannot be uplifted relative to its adjacent block 20. Instead, the uplift forces are transmitted therebetween so as to be distributed about the plurality of adjacent, interconnected blocks 20 making up the roof surface 38. In preferred form and as illustrated in FIG. 1, the clamp 102 is preferably utilized in at least the first two or three rows surrounding the perimeter of the roof assembly 38, although it may be utilized throughout the entire structure as desired.

As can be seen from the above, the present invention provides a highly desirable ballast block structure having a number of advantageous features for use in constructing single-ply roofs and the like. The ballast block of the present invention provides drainage in two directions. This bi-directional drainage feature prevents ponding and problems resulting from ponding, such as uplift of blocks resulting from the freezing of ponded water beneath the roof ballast blocks. Moreover, the ballast block of the present invention provides a plurality of bottom members upon which it rests, each member being rounded at its corners so as to prevent any puncture of the membrane lying beneath the ballast block. In addition to the normal features of ballast blocks which prevent fire from external sources as well as exposure to sunlight, the block of the present invention prevents wind uplift and rotational displacement due to the interlinking structure of the present invention. Finally, the present invention provides a solid roofing surface which can be readily walked on without causing damage below its bottom surface due to its interlinking structure as well as its bottom surface configuration. Since the ballast block of the present invention is bidirectional in drainage, it can be readily used with flat roofs having slight pitches outwardly to the exterior edges of the roof or inwardly toward a center line drainage member. Moreover, the ballast blocks of the present invention may be laid along either major axis of a roof without concern for drainage pattern due to its bidirectional drainage feature.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein, but may be modified within the scope of the appended claims.

I claim:

1. A ballast block adapted to rest upon a supporting surface without being attached to the supporting surface, said ballast block comprising a planar plate member having top and bottom surfaces, front and rear end portions, and oppositely disposed lateral edges, said bottom surface including a plurality of pad members upon which said ballast block is adapted to rest and engage the supporting surface to permit the flow of liquid beneath said bottom surface, said end portions including means for preventing substantial uplift and rotational displacement of said block when said end portions are interlinked in overlapping relationship with the corresponding end portions of similarly oriented like ballast blocks, said uplift prevention juncture of said second end surface and the bottom surface of said block is rounded to substantially prevent puncture of material underlying said block.

2. The ballast block as claimed in claim 1, wherein said block comprises integrally molded concrete.

3. The ballast block as claimed in claim 1, wherein said third end surface of each said end portion is inclined 10°–40° with respect to the plane of said planar plate member.

4. The ballast block as claim in claim 3, wherein said third end surface is inclined at 15°–20° relative to said plane.

5. The ballast block as claimed in claim 1, wherein said third inclined end surface of each said end portion intersects one of said first and second end surfaces, and wherein each said end portion includes a fourth end surface aligned substantially parallel to the plane of said plate member and which interconnects said inclined third surface with the other of said first and second surfaces.

6. The ballast block as claimed in claim 1, wherein the second end surface of said front end portion is aligned inwardly toward the interior of said ballast block relative to said first end surface thereof, and wherein the means of each said front and rear end portion including first and second end surfaces extending between said lateral edges and aligned substantially perpendicular to, respectively, said top and bottom surfaces, said end surfaces being spaced from each other by a third inclined end surface aligned obliquely to said top and bottom surfaces, the front end portion of said block being adapted for cooperative, interlinking relationship with the rear end portion of a substantially identical, adjacent ballast block.

7. The ballast block as claim in claim 1, wherein said uplift prevention means of each said end portion comprises a substantially inverse image of an opposite end portion of said ballast block.

8. The ballast block as claimed in claim 1, wherein said pad members are rounded.

9. The ballast block as claimed in claim 1, wherein said bottom surface includes a plurality of rib-like members upon which said block is adapted to rest, said rib-like members including cross channels disposed therein to permit the bi-directional flow of liquid beneath said bottom surface from lateral edge to lateral edge and from front end portion to rear end portion thereof.

10. The ballast block as claimed in claim 9, wherein said ballast block is severable from front to rear end portions mid-way between said lateral edges such that each of the resulting ballast block sections formed after severance of said block are substantially identical.

11. The ballast block as claimed in claim 9, wherein said rib-like members extend from lateral edge to lateral edge of said block and project downwardly from said bottom surface to permit liquid to flow parallel with and between said rib-like members, and wherein said cross-channels are disposed in said rib-like members to permit cross flow of liquid between said rib-like members from front end portion to rear end portion of said block.

12. The ballast block as claimed in claim 11, wherein said bottom surface includes a plurality of hollowed-out portions disposed between said rib-like members.

13. The ballast block as claimed in claim 12, wherein said bottom surface includes three said rib-like members spaced equidistantly apart.

14. The ballast block as claimed in claim 12, wherein said bottom surface includes a ridge disposed mid-way from front to rear end portions thereof, said ridge bifurcating said block into two substantially equal and identical sections.

15. The ballast block as claimed in claim 14, wherein said ridge is adapted to be severed longitudinally to divide said block into two substantially identical sections.

16. A ballast block assembly comprising:

a plurality of ballast blocks, each said block adapted to rest upon a supporting surface without being attached to the supporting surface, each said block being in the form of a planar plate member having top and bottom surfaces, front and rear end portions aligned substantially orthogonally to a first plate axis, and oppositely disposed lateral side portions aligned substantially orthogonally to a second plate axis, said axes lying within the plane of said plate member, said bottom surface including a plurality of pad members upon which said ballast block is adapted to rest and engage the supporting surface to permit the flow of liquid beneath said bottom surface;

each said end portion including means for linking adjacently aligned blocks to prevent substantial uplift and rotational displacement of said blocks when the front and rear end portions of each block are interconnected in overlapping relationship with corresponding front and rear end portions of adjacent blocks;

said plurality of blocks being aligned to abut the lateral side portions of aligned blocks and to interlink in overlapping relationship the front and rear end portions of adjacent blocks; and means for clamping the abutting lateral side portions of at least a portion of said aligned blocks.

17. The ballast block assembly as claimed in claim 16, wherein said adjacent ballast blocks are arranged in a staggered formation to prevent the alignment of side portions between rows of said blocks.

18. The ballast block assembly as claimed in claim 16, wherein said linking means of each said end portion comprises first and second end surfaces extending between said oppositely disposed lateral side portions and aligned substantially parallel to said second axis, said end surfaces being spaced from each other by a third inclined end surface aligned obliquely to the plane of said plate member.

19. The ballast block assembly as claimed in claim 18, wherein said third inclined surface of each said end portion is inclined approximately 10°–40° with respect to said plane.

20. The ballast block assembly as claimed in claim 19, wherein each said third inclined end surface is inclined approximately 15°–20° relative to said plane.

21. The ballast block assembly as claimed in claim 18, wherein said third inclined end surface directly intersects one of said first and second end surfaces, and wherein said linking means further includes a fourth end surface aligned substantially parallel to said plane and along said second axis, said fourth end surface interconnecting said inclined third end surface with the other of said first and second end surfaces.

22. The ballast block assembly as claimed in claim 16, wherein said assembly is adapted for forming a roof covering over a waterproof layer substantially without puncturing or rupturing said underlying layer.

23. The ballast block assembly as claimed in claim 22, wherein said pad members are rounded and are adapted to prevent rupture or tearing of said underlying layer.

24. The ballast block assembly as claimed in claim 16, wherein each said block includes a plurality of rib-like members upon which said block is adapted to rest, said rib-like members including cross channels disposed therein to permit the bi-directional flow of liquid beneath said bottom surface along both said axes.

25. A single ply roof assembly for covering a deck surface of a substantially flat roof structure, said roof assembly comprising:

an insulation layer disposed on said deck;

a waterproof layer disposed on said insulation layer; and a plurality of interlinked ballast blocks covering a substantially portion of said waterproof layer, each ballast block adapted to rest upon the deck surface without being attached to the deck surface, each said ballast block being in the form of a planar plate member having top and bottom surfaces, front and rear end portions aligned substantially orthogonally to a first plate axis, and oppositely disposed lateral side portions aligned substantially orthogonally to a second plate axis, said bottom surface including a plurality of pad members upon which said ballast block is adapted to rest and engage said waterproof layer to permit the flow of liquid beneath said bottom surface, said axes lying within the plane of said plate member and each said end portion including means for linking adjacently aligned blocks to prevent substantial uplift and rotational displacement of said blocks when the end portions thereof are interconnected in overlapping relationship with corresponding end portions of adjacent blocks; and said plurality of blocks being aligned such that said blocks abut each other in rows along said lateral side portions and interlink each other in overlapping relationship along said front and rear end portions.

26. The roof assembly as claimed in claim 25, wherein said assembly further includes means for clamping the abutting lateral side portions of at least the first two rows of said blocks along at least a portion of the periphery of said roof structure.

27. The roof assembly as claimed in claim 26, wherein said rows of blocks are aligned in staggered formation from forward to rearward end portions to prevent alignment of the abutting lateral side portions of one row of blocks with the abutting lateral side portions of either adjacent row of blocks.

28. The roof assembly as claimed in claim 25, wherein said linking means of each end portion of each said block includes first and second end surfaces extending between said lateral side portions substantially parallel to said second axis and substantially perpendicular to said top and bottom surfaces, said end surfaces being spaced from each other by a third inclined end surface aligned obliquely to said plane, the front end portion of said block being adapted for cooperative, mating relationship with the rear end portion of a substantially identical, adjacent ballast block.

29. The roof assembly as claimed in claim 25, wherein each said block includes a plurality of rib-like members disposed along the bottom surface thereof and upon which said block is adapted to rest, said rib-like members including cross channels disposed therein to permit the bi-directional flow of liquid beneath said bottom surface along both said first and second axis.

30. The roof assembly as claimed in claim 29, wherein each said block is interlinked with adjacent blocks to permit the flow of liquid beneath said plurality of blocks and above said waterproof layer in accordance with the pitch of said roof structure.

31. A method of covering a roof with ballast material comprising:

forming a plurality of ballast blocks from concrete, each ballast block adapted to rest upon the roof without being attached to the roof, each said ballast block being capable of providing a weight of at least 10 pounds per square foot, with each said block being in the form of a planar plate member having top and bottom surfaces, front and rear end portions, and oppositely disposed lateral side portions, said bottom surface including a plurality of pad members upon which said ballast block is adapted to rest and engage the roof to permit the flow of liquid beneath said bottom surface, each said end portion including means for linking adjacently aligned blocks to prevent substantial uplift and rotational displacement of said blocks when the end portions thereof are linked in an overlapping relationship with corresponding end portions of adjacent blocks;

aligning said concrete ballast blocks adjacent to each other along said lateral side portions to form a plurality of rows of said blocks, with each said row of blocks being staggered relative to adjacent rows and being interlinked at their front and rear end portions in overlapping relationship with the corresponding end portions of adjacent rows of blocks; and connecting the lateral side portions of said blocks in at least the first two rows along at least a portion of the entire perimeter of said roof.

32. A ballast block adapted to rest upon a supporting surface without being attached to the supporting surface, said ballast block comprising a planar plate member having top and bottom surfaces, front and rear end portions, and oppositely disposed lateral edges, said bottom surface including a plurality of pad members upon which said ballast block is adapted to rest and engage the supporting surface to permit the flow of liquid beneath said bottom surface, said end portions including means for preventing substantial uplift and rotational displacement of said block when said end portions are interlinked in overlapping relationship with the corresponding end portions of similarly oriented like ballast blocks, said uplift prevention means of each said end portion comprising a substantially inverse image of an opposite end portion of said ballast block.

33. The ballast block as claim in claim 22, wherein said uplift prevention means of each said front and rear end portion including first and second end surfaces extending between said lateral edges and aligned substantially perpendicular to, respectively, said top and bottom surfaces, said end surfaces being spaced from each other by a third inclined end surface aligned obliquely to said top and bottom surfaces, the front end portion of said block being adapted for cooperative, interlinking relationship with the rear end portion of a substantially identical, adjacent ballast block.

34. The ballast block as claimed in claim 33, wherein said block comprises integrally molded concrete.

35. The ballast block as claimed in claim 33, wherein said third end surface of each said end portion is inclined 10°–40° with respect to the plane of said planar plate member.

36. The ballast block as claimed in claim 35, wherein said third end surface is inclined at 15°–20° relative to said plane.

37. The ballast block as claimed in claim 33, wherein said third inclined end surface of each said end portion intersects one of said first and second end surfaces, and wherein each said end portion includes a fourth end surface aligned substantially parallel to the plane of said plate member and which interconnects said inclined third surface with the other of said first and second surfaces.

38. The ballast block as claimed in claim 33, wherein the second end surface of said front end portion is aligned inwardly toward the interior of said ballast block relative to said first end surface thereof, and wherein the juncture of said second end surface and the bottom surface of said block is rounded to substantially prevent puncture of material underlying said block.

39. The ballast block as claimed in claim 32, wherein said pad members are rounded.

40. The ballast block as claimed in claim 32, wherein said bottom surface includes a plurality of rib-like members upon which said block is adapted to rest, said rib-like members including cross channels disposed therein to permit the bi-directional flow of liquid beneath said bottom surface from lateral edge to lateral edge and from front end portion to rear end portion thereof.

41. The ballast block as claimed in claim 40, wherein said ballast block is severable from front to rear end portions mid-way between said lateral edges such that each of the resulting ballast block sections formed after severance of said block are substantially identical.

42. The ballast block as claimed in claim 40, wherein said rib-like members extend from lateral edge to lateral edge of said block and project downwardly from said bottom surface to permit liquid to flow parallel with and between said rib-like members, and wherein said cross-channels are disposed in said rib-like members to permit cross flow of liquid between said rib-like members from front end portion to rear end portion of said block.

43. The ballast block as claimed in claim 42, wherein said bottom surface includes a plurality of hollowed-out portions disposed between said rib-like members.

44. The ballast block as claimed in claim 43, wherein said bottom surface includes three said rib-like members spaced equidistantly apart.

45. The ballast block as claimed in claim 43, wherein said bottom surface includes a ridge disposed mid-way from front to rear end portions thereof, said ridge bifurcating said block into two substantially equal and identical sections.

46. The ballast block as claimed in claim 45, wherein said ridge is adapted to be severed longitudinally to divide said block into two substantially identical sections.

47. A ballast block adapted to rest upon a supporting surface without being attached to the supporting surface, said ballast block comprising a planar plate member having top and bottom surfaces, front and rear end portions, and oppositely disposed lateral edges, said bottom surface including a plurality of rib-like members upon which said block is adapted to rest and engage the supporting surface, said rib-like members including cross channels disposed therein to permit the bi-directional flow of liquid beneath said bottom surface from lateral edge to lateral edge and from front end portion to rear end portion thereof, said end portions including means for preventing substantial uplift and rotational displacement of said block when said end portions are interlinked in overlapping relationship with the corresponding end portions of similarly oriented like ballast blocks.

48. The ballast block as claim in claim 47, wherein said uplift prevention means of each said front and rear end portion including first and second end surfaces extending between said lateral edges and aligned substantially perpendicular to, respectively, said top and bottom surfaces, said end surfaces being spaced from each other by a third inclined end surface aligned obliquely to said top and bottom surfaces, the front end portion of said block being adapted for cooperative, interlinking relationship with the rear end portion of a substantially identical, adjacent ballast block.

49. The ballast block as claimed in claim 48, wherein said block comprises integrally molded concrete.

50. The ballast block as claimed in claim 48, wherein said third end surface of each said end portion is inclined 10°–40° with respect to the plane of said planar plate member.

51. The ballast block as claimed in claim 50, wherein said third end surface is inclined at 15°–20° relative to said plane.

52. The ballast block as claimed in claim 48, wherein said third inclined end surface of each said end portion intersects one of said first and second end surfaces, and wherein each said end portion includes a fourth end surface aligned substantially parallel to the plane of said plate member and which interconnects said inclined third surface with the other of said first and second surfaces.

53. The ballast block as claimed in claim 48, wherein the second end surface of said front end portion is aligned inwardly toward the interior of said ballast block relative to said first end surface thereof, and wherein the juncture of said second end surface and the bottom surface of said block is rounded to substantially prevent puncture of material underlying said block.

54. The ballast block as claimed in claim 47, wherein said uplift prevention means of each said end portion comprises a substantially inverse image of an opposite end portion of said ballast block.

55. The ballast block as claimed in claim 47, wherein said rib-like members are rounded.

56. The ballast block as claimed in claim 47, wherein said ballast block is severable from front to rear end portions mid-way between said lateral edges such that each of the resulting ballast block sections formed after severance of said block are substantially identical.

57. The ballast block as claimed in claim 47, wherein said rib-like members extend from lateral edge to lateral edge of said block and project downwardly from said bottom surface to permit liquid to flow parallel with and between said rib-like members, and wherein said cross-channels are disposed in said rib-like members to permit cross flow of liquid between said rib-like members from front end portion to rear end portion of said block.

58. The ballast block as claimed in claim 57, wherein said bottom surface includes a plurality of hollowed-out portions disposed between said rib-like members.

59. The ballast block as claimed in claim 58, wherein said bottom surface includes three said rib-like members spaced equidistantly apart.

60. The ballast block as claimed in claim 58, wherein said bottom surface includes a ridge disposed mid-way from front to rear end portions thereof, said ridge bifurcating said block into two substantially equal and identical sections.

61. The ballast block as claimed in claim 60, wherein said ridge is adapted to be severed longitudinally to divide said block into two substantially identical sections.

62. A roof assembly comprising:

a substantially flat, substantially waterproof roof; and a ballast block resting upon said roof without being attached to said roof, said ballast block comprising a planar plate member having top and bottom surfaces, front and rear end portions, and oppositely disposed lateral edges, said bottom surface including a plurality of pad members upon which said ballast block is adapted to rest and engage said roof to permit the flow of liquid beneath said bottom surface, said end portions including means for preventing substantial uplift and rotational displacement of said block when said end portions are interlinked in overlapping relationship with the corresponding end portions of similarly oriented like ballast blocks.

63. The roof assembly as claim in claim 62, wherein said uplift prevention means of each said front and rear end portion including first and second end surfaces extending between said lateral edges and aligned substantially perpendicular to, respectively, said top and bottom surfaces, said end surfaces being spaced from each other by a third inclined end surface aligned obliquely to said top and bottom surfaces, the front end portion of said block being adapted for cooperative, interlinking relationship with the rear end portion of a substantially identical, adjacent ballast block.

64. The roof assembly as claimed in claim 63, wherein said block comprises integrally molded concrete.

65. The roof assembly as claimed in claim 63, wherein said third end surface of each said end portion is inclined 10°–40° with respect to the plane of said planar plate member.

66. The roof assembly as claimed in claim 65, wherein said third end surface is inclined at 15°–20° relative to said plane.

67. The roof assembly as claimed in claim 63, wherein said third inclined end surface of each said end portion intersects one of said first and second end surfaces, and wherein each said end portion includes a fourth end surface aligned substantially parallel to the plane of said plate member and which interconnects said inclined third surface with the other of said first and second surfaces.

68. The roof assembly as claimed in claim 63, wherein the second end surface of said front end portion is aligned inwardly toward the interior of said ballast block relative to said first end surface thereof, and wherein the juncture of said second end surface and the bottom surface of said block is rounded.

69. The roof assembly as claimed in claim 62, wherein said uplift prevention means of each said end portion comprises a substantially inverse image of an opposite end portion of said ballast block.

70. The roof assembly as claimed in claim 62, wherein said pad members are rounded.

71. The roof assembly as claimed in claim 62, wherein said bottom surface includes a plurality of rib-like members upon which said block is adapted to rest, said rib-like members including cross-channels disposed therein to permit the bi-directional flow of liquid beneath said bottom surface from lateral edge to lateral edge and from front end portion to rear end portion thereof.

72. The roof assembly as claimed in claim 71, wherein said ballast block is severable from front to rear end portions mid-way between said lateral edges such that each of the resulting ballast block sections formed after severance of said block are substantially identical.

73. The roof assembly as claimed in claim 71, wherein said rib-like members extend from lateral edge to lateral edge of said block and project downwardly from said bottom surface to permit liquid to flow parallel with and between said rib-like members, and wherein said cross-channels are disposed in said rib-like members to permit cross flow of liquid between said rib-like members from front end portion to rear end portion of said block.

74. The roof assembly as claimed in claim 73, wherein said bottom surface includes a plurality of hollowed-out portions disposed between said rib-like members.

75. The roof assembly as claimed in claim 74, wherein said bottom surface includes three said rib-like members spaced equidistantly apart.

76. The roof assembly as claimed in claim 74, wherein said bottom surface includes a ridge disposed mid-way from front to rear end portions thereof, said ridge bifurcating said block into two substantially equal and identical sections.

77. The roof assembly as claimed in claim 76, wherein said ridge is adapted to be severed longitudinally to divide said block into two substantially identical sections.

* * * * *